United States Patent [19]

Brastad

[11] 4,267,420

[45] May 12, 1981

[54] PACKAGED FOOD ITEM AND METHOD FOR ACHIEVING MICROWAVE BROWNING THEREOF

[75] Inventor: William A. Brastad, Minneapolis, Minn.

[73] Assignee: General Mills, Inc., Minneapolis, Minn.

[21] Appl. No.: 950,757

[22] Filed: Oct. 12, 1978

Related U.S. Application Data

[63] Continuation-in-part of Ser. No. 910,245, May 30, 1978, abandoned.

[51] Int. Cl.[3] ..... H05B 6/80

[52] U.S. Cl. ..... 219/10.55 E; 219/10.55 F; 229/3.5 MF; 229/87 F; 426/107

[58] Field of Search ..... 219/10.55 E, 10.55 M, 219/10.55 F, 10.55 R; 426/107, 234; 229/3.5 MF, 87 F

[56] References Cited

U.S. PATENT DOCUMENTS

| | | | |
|---|---|---|---|
| 1,246,650 | 11/1917 | Peterson | 229/3.5 MF |
| 1,944,323 | 1/1934 | Kilchling | 229/3.5 MF |
| 2,951,765 | 9/1960 | Robson | 229/3.5 MF |
| 3,286,904 | 11/1966 | Vieth et al. | 229/3.5 MF |
| 3,302,632 | 2/1967 | Fichtner | 219/10.55 E |
| 3,490,580 | 1/1970 | Brumfield et al. | 219/10.55 E |
| 3,554,770 | 1/1971 | Lipsky et al. | 229/3.5 MF |
| 3,712,848 | 1/1973 | Casey, Jr. et al. | 229/3.5 MF |
| 3,783,220 | 1/1974 | Tanizaki | 219/10.55 E |
| 4,015,085 | 3/1977 | Woods | 219/10.55 E |
| 4,144,438 | 3/1979 | Gelman et al. | 219/10.55 E |

*Primary Examiner*—Arthur T. Grimley
*Attorney, Agent, or Firm*—Gene O. Enockson; L. MeRoy Lillehaugen

[57] ABSTRACT

A food item is wrapped with plastic film or other dielectric substrate having a very thin coating thereon which controls the microwave conductivity when the package is placed within a conventional microwave oven. The plastic film or other substrate and its coating conform to a substantial surface portion of the food item. The coated plastic film or other substrate converts some of the microwave energy into heat which is transmitted directly to the surface portion so that a browning and/or crispening is achieved. The coating has the additional capability of modifying the microwave field configuration so as to further enhance the heating of the food surface immediately adjacent the film in which the food is packaged. The microwave energy not converted into heat by the coated film passes through the film to dielectrically heat the single food item as is normally done when cooking with microwaves.

12 Claims, 4 Drawing Figures

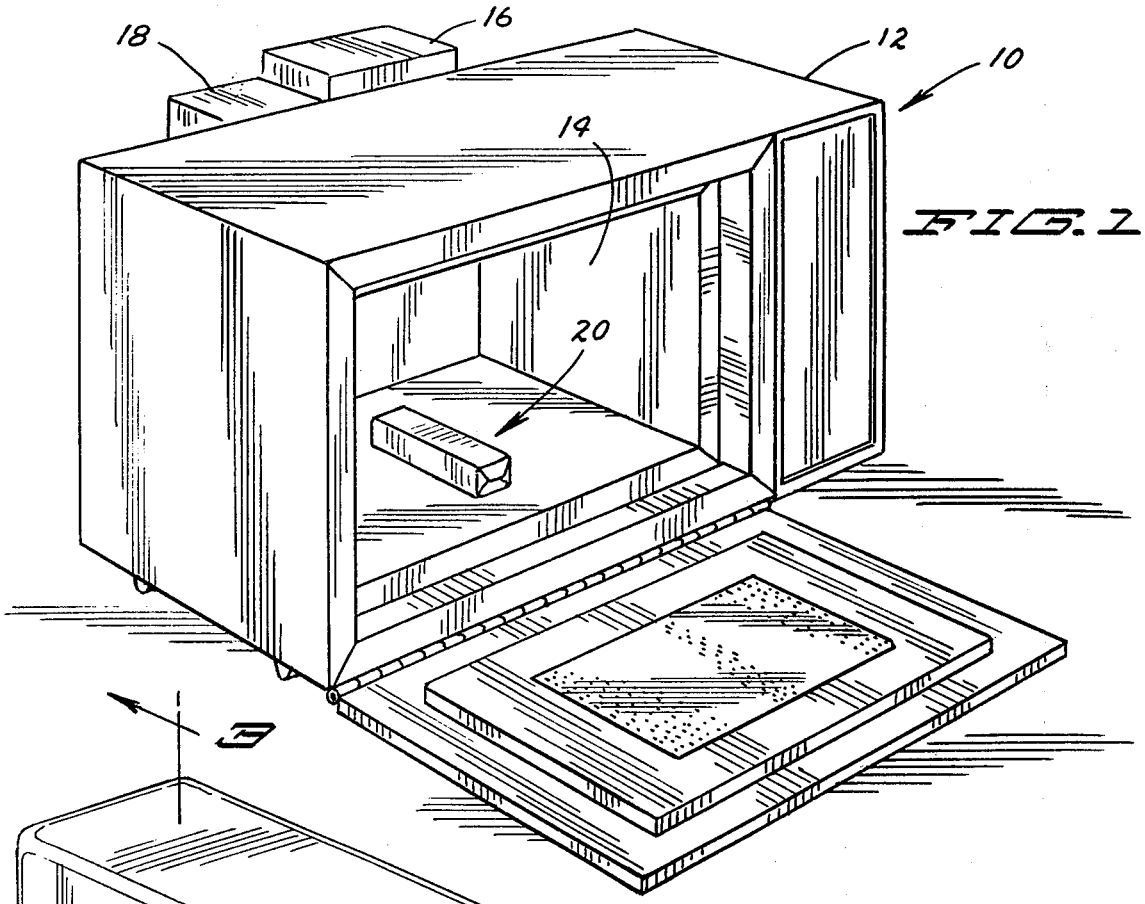
FIG. 1
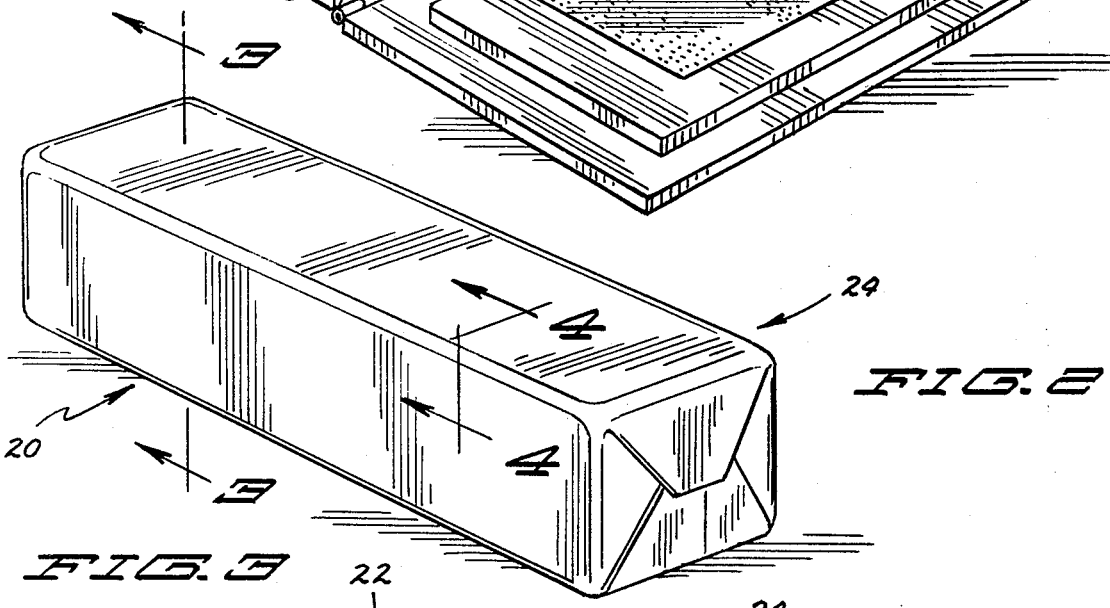
FIG. 2
FIG. 3
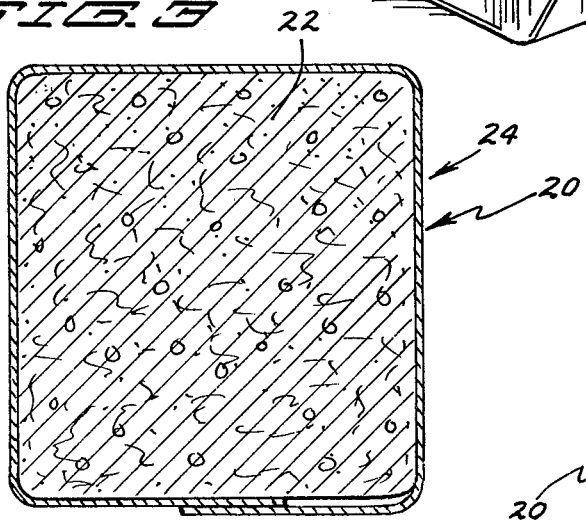
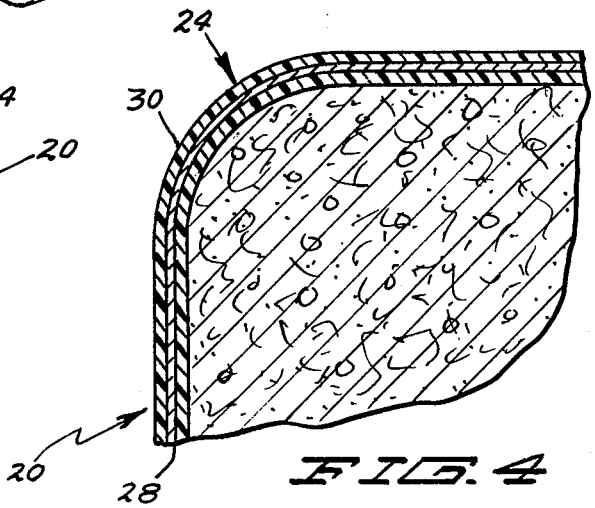
FIG. 4

PACKAGED FOOD ITEM AND METHOD FOR ACHIEVING MICROWAVE BROWNING THEREOF

This application is a continuation-in-part of my earlier filed application Ser. No. 910,245, filed May 30, 1978, now abandoned.

BACKGROUND OF THE INVENTION

1. Field of the Invention

This invention relates generally to the packaging of food items to be heated in a microwave oven, and pertains more particularly to a food item which is wrapped with a plastic film or other dielectric substrate such as paper having a thin coating so that the coating converts some of the microwave energy into thermal energy which promotes surface browning or crispening of the food while still packaged.

2. Description of the Prior Art

The heating of food articles with microwave energy has now become commonplace. It is widely recognized, however, that the molecular friction resulting from the high frequency oscillation fails to impart the proper amount of so-called browning and/or crispness to foods normally expected to possess such a quality. Consequently, foods of the foregoing type, after being heated or cooked in a microwave oven, do not possess the requisite degree of eye appeal and taste appeal that one normally expects.

Various attempts have been made to correct for the inherent lack of browning (or crispening) when employing microwave heating. Such attempts have included the physical modification of the microwave oven, namely, the adding of electric boiling elements that produce the needed shorter wavelength energy for obtaining the browning of the food. Also, means have been incorporated into the microwave oven which convert the high frequency energy by resistive losses to heat energy; here again, this requires the adding of elements to the microwave oven itself. At any rate, various lossy devices have been incorporated into microwave ovens in order to achieve the requisite or desired surface coloration of food.

Additionally, edible coatings have been added to the food itself in order to induce browning and crispening. Still further, various utensils or dishes have been devised which will promote browning.

Various shortcomings, however, have attended the different prior art attempts known to me. Some have been costly, particularly those requiring modification or the adding of components to a microwave oven. Utensils or dishes can be made to add heat to the food surface for browning but cannot be wrapped around the product. Furthermore, such utensils and dishes are costly and require preheating because of their large thermal mass.

SUMMARY OF THE INVENTION

An important object of the invention is to wrap a food item intended to be heated in a microwave oven with plastic film or other dielectric substrate having a thin coating thereon of a material such that some of the microwave energy will be converted to thermal energy, the coated substrate generally conforming to the shape of the food item so that the microwave energy that is converted to thermal energy produces a browning and/or crispening.

Another object of my invention is to control the browning of an item of food when placed in a microwave oven by using a plastic film having a coating thereon of a specific conductivity (or conversely specific resistivity) such as to convert a desired proportion of the microwave energy to heat energy, permitting the remainder of the microwave energy to pass through the plastic film.

The invention also has as an object the provision of inexpensive wrapping material which effects browning or crispening of the food contained therein, yet which, because of its low cost, can be discarded and not reused. In this regard, an aim of the invention is to provide a prepackaged food item that automatically achieves microwave browning or crispening with little or no increase in packaging costs.

Still further, an object is to provide a very easy and convenient way to effect the browning or crispening of certain foods, the user not having to remove the food from the package in order to obtain the browning. In other words, when practicing the teachings of my invention, the browning is automatically realized by merely placing the entire package in a microwave oven.

Yet another object of my invention is to provide a method for achieving microwave browning or crispening of a food article in which the conversion of microwave energy to thermal energy occurs in a proximal or closely adjacent relationship with the surface portion of the food to be browned.

Also, an object is to provide prepackaged food in which the packaging material has a very small thermal mass, thus obviating any taking of the heat from the food itself during the microwave heating thereof. Consequently, it is within the purview of my invention to provide an item of food in combination with wrapping material which will not require any preheating, such as that needed when employing browning utensils or dishes.

A further object is to avoid the degradation that has transpired in the past with respect to utensils or dishes used repeatedly to brown foods. Such degradation comes about largely from having to clean the various utensils or dishes. With my invention, the wrapping material is removed and discarded after the food item has been cooked. No cleaning whatsoever is necessary.

Still another object of the invention is to provide an item of food having a wrapping material possessing the foregoing attributes which material will be aesthetically pleasing as well as useful, particularly inasmuch as the coating can possess a tint or color so as to enhance the appearance of the prepackaged food.

Quite briefly, my invention contemplates plastic film or other dielectric substrate having a thin coating applied thereto which, in combination with a food item, converts some of the microwave energy supplied by microwave oven into heat, the heat being generated closely adjacent the outer surface of the item of food. The heat so produced promotes a browning or crispening of the food, owing to the proximity of the coated plastic film or other substrate to its outer surface. The microwave energy not converted into thermal energy passes through the coated film which has a degree of transparency to energy in the microwave frequency range. The microwave energy passing through the wrapping material is utilized for dielectrically heating the food item, as microwaves normally do.

BRIEF DESCRIPTION OF THE DRAWINGS

FIG. 1 is a perspective view of a microwave oven with the front open so as to expose to view a single fish stick prepackaged in accordance with my invention;

FIG. 2 is an enlarged perspective view of the prepackaged fish stick appearing in FIG. 1;

FIG. 3 is a sectional view taken through the prepackaged fish stick in the direction of line 3—3 of FIG. 2, and FIG. 4 is a greatly enlarged fragmentary sectional view taken in the direction of line 4—4 of FIG. 2, the enlarged scale permitting the exaggerated showing of the very thin coating located between inner and outer flexible layers or films of plastic.

DESCRIPTION OF THE PREFERRED EMBODIMENT

Referring first to FIG. 1, a conventional microwave oven 10 has been illustrated. The oven 10 comprises a cabinet 12 containing a cooking cavity 14 in which food is placed in order to be heated by microwave energy. Although my invention is susceptible to use with various high frequencies capable of producing molecular friction, one officially approved microwave frequency is on the order of 2450 MHz. The microwave energy is introduced into the cavity 14 from a high frequency energy source 16, such as a magnetron, through a waveguide 18. The electromagnetic waves are radiated and reflected within the cavity 14 and such energy is absorbed by the food to be heated.

In FIG. 1, a single package 20 has been depicted. This same package appears in FIG. 2 on a larger scale. FIG. 3 is a cross-section through the package 20 and shows that the food item constitutes a fish stick 22. In this regard, fish sticks exemplify food products having an exterior that should be both browned and crispened in order to enhance the appearance and taste thereof. However, my invention will be of benefit in the browning and/or crispening of other foods, such as onion rings and various forms of potatoes.

Describing now the wrapping or packaging material that closely conforms to the shape of the fish stick 22, such material has been denoted generally by the reference number 24. The wrapping material 24 is preferably comprised of a first plastic sheet or thin film 26 which typically has a thickness of approximately 0.0005 to 0.001 inch. The plastic film 26 is of polyester.

The wrapping or packaging material further includes a very thin coating 28 on the plastic film 26, the coating 28 having a surface resistivity of approximately about 1 to 300 ohms per square, and preferably about 1 to 10 ohms per square. It will be understood that a resistivity of 1 ohm per square denotes a heavier or thicker coating than a coating of the same material having a 10 ohms per square resistivity. Admirably suited for the coating material would be aluminum which can be readily evaporated onto the plastic film 26 by conventional methods. Obviously, other materials, such as tin oxide, chromium, magnesium, silver and gold, can be used. However, aluminum is very inexpensive and has been widely used in the form of aluminum foil as far as the general packaging of food is concerned.

Owing to the thinness of the material constituting the coating 28, it has very little thermal mass. Thicknesses of only 0.5 to $20\times10^{-6}$ inch can be readily realized. The thickness, of course, is correlated with the resistivity, and whatever coating material that is selected should have a thickness such as to provide a surface resistivity falling within the range hereinbefore given. Aluminum has the added capability of being readily evaporated uniformly onto the plastic film 26 in forming a satisfactory thin coating 28.

An additional sheet or film 30 of plastic is laminated to the coating 28, such as by adhesion. In this instance, the film 30 is preferably of polyethylene, having substantially the same thickness as the polyester film 26.

Consequently, it will be recognized that the coated wrapping material 24 is not only very thin but quite flexible, as well. Thus, when the fish stick 22 is wrapped with the material 24, the coating 28, being also flexible, will conform to the shape of the particular item of food, which in this instance has been identified as a fish stick 22.

Not only does the coated packaging material 24 conform to a substantial surface portion of the fish stick 22, but it should be recognized that the coating 28 is in close proximity with the surface of the fish stick 22 that is to be browned and crispened. In this way, the heat generated by the coating 28 is transmitted directly into the outer surface of the fish stick 22, imparting the desired browning and crispening thereto.

When the package 20 is subjected to microwave energy, only some of the microwave energy impinging on the package 20 is converted into heat by the coating 28. Initially, electric currents are induced in various portions of the coating 28, and the heat resistively generated subdivides the coating 28 into a myriad of irregularly contoured islands with dielectric channels extending therebetween. Once this occurs, then the individual islands, which might be termed semiconducting because of their extreme thinness, act as plates of a capacitor so as to further build up potential differences between adjacent islands which increased voltages cause a more pronounced heating to occur, the current flowing from an island of one potential to an adjacent island of a different potential. As the current flows back and forth through the dielectric layer 26 or 30, as the case may be, the heat provided is conducted directly into the outer surface of the fish stick 22, thereby imparting a color change thereto in the form of browning, accompanied by a crispening of the outer surface, too.

The above alluded-to heating action is enhanced also by the modification of the microwave field configuration that occurs by reason of the semiconducting coating 28. In this regard, more of the available microwave energy in the cavity 14 is utilized as a result of using the coated wrapping or packaging material 24 in close proximity to the food product. Stated somewhat differently, the food 22 receives more microwave heating with my packaging or wrapping material 24 than without the material 24. This additional heat, together with the resistively derived heat, is concentrated immediately innerjacent the packaging material 24, which is at the outer surface of the food 22 where it is effectively used in achieving a desired degree of browning and crispening.

It will be appreciated that the specific resistance of a coating 28 is susceptible to variation and that within limits the thicker such coating is the less pervious or more opaque it is to the passage of microwave energy therethrough. Hence, in order to promote a greater degree of browning, the coating 28 would be thicker than when a lesser degree of browning is desired. In this way, the browning or crispening can be correlated with the actual dielectric heating of the fish stick 22.

Stated somewhat differently, the coating 28 can be relied upon, depending upon its particular thickness, to transform a given percentage or portion of the microwave energy into thermal energy and such energy is employed in achieving the desired degree of browning or crispening. However, that portion of the microwave energy not converted to heat energy, enters into the fish stick 22 and dielectrically heats the fish stick in a conventional manner by molecular friction.

It is also to be appreciated that the flexible wrapping materials used in the present invention can be supported exteriorly by more rigid dielectric materials such as paperboard and the like.

Although it is believed that sufficient information has been given herein with respect to the coating 28, should additional details be desired, reference may be made to the book titled *Modern Microelectronics* authored by Dr. Max Fogiel and published by Research and Education Association (1972) which contains an entire chapter on thin film principles, pages 94–100 dealing with resistive and conductive films and page 95 showing a curve with resistivity plotted against thickness for thin metallic films.

As indicated, it is believed that the coating 28 has been described with sufficient particularity to enable my invention to be practiced. However, for the lack of a completely definitive generic word in the broader claims, the term "semiconducting" will be used.

I claim:

1. In combination with a food item capable of having its color changed or being crispened by thermal energy, said food item to be heated in a microwave oven, wrapping material conforming generally to the shape of said food item comprising a flexible dielectric substrate having a thin semiconducting coating thereon residing in a close proximal relation to a substantial surface portion of said food item, said thin semiconducting coating having the property of being able to convert a proportion of the microwave energy of a microwave oven into heat in the coating itself to thereby change the color or crispness of the surface of the food item while permitting the remainder of the said microwave energy to pass through the wrapping material to dielectrically heat the food item.

2. The combination of claim 1 in which said semiconducting coating has a specific surface resistance of from about 1 to 300 ohms per square.

3. The combination set forth in claim 2 in which said semiconducting coating has a specific surface resistance of from about 1 to about 10 ohms per square.

4. The combination set forth in claim 2 in which the coating is evaporated aluminum.

5. The combination set forth in claim 2 in which said dielectric substrate constitutes a polyester film.

6. The combination set forth in claim 5 including a second plastic layer constituting a polyethylene film, said coating being sandwiched between said polyester and polyethylene films.

7. In combination with a food item capable of having its color changed or being crispened by thermal energy, said food item to be heated in a microwave oven, flexible dielectric material having a substantial portion thereof conforming generally to the shape of the food item, and a relatively thin flexible layer of metal carried by said dielectric material, said metallic layer also conforming generally to the shape of said food item and residing in a proximal relation thereto and having the property of being able to convert a proportion of the microwave energy of a microwave oven into heat in the metallic layer itself to thereby change the color or crispness of the surface of the food item adjacent thereto while permitting the remainder of the said microwave energy to pass through the metallic layer and the flexible dielectric material to dielectrically heat the food item.

8. The combination set forth in claim 7 in which said metallic layer has a specific surface resistivity between about 1 to 300 ohms per square.

9. The combination set forth in claim 8 in which said metallic layer has a specific surface resistivity between about 1 to 10 ohms per square.

10. The combination set forth in claim 7 in which said flexible dielectric material constitutes a polyester film, said metallic layer having been evaporated onto said plastic film.

11. The combination set forth in claim 10 in which a second plastic film is included said second plastic film confronting the other side of said metallic layer.

12. The combination set forth in claim 11 in which said second plastic film is polyethylene.

* * * * *